US011878826B2

(12) United States Patent
Nilsson

(10) Patent No.: US 11,878,826 B2
(45) Date of Patent: Jan. 23, 2024

(54) TUBE FILLING MACHINE

(71) Applicant: Norden Machinery AB, Kalmar (SE)

(72) Inventor: Jan Nilsson, Kalmar (SE)

(73) Assignee: Norden Machinery AB, Kalmar (SE)

( * ) Notice: Subject to any disclaimer, the term of this patent is extended or adjusted under 35 U.S.C. 154(b) by 95 days.

(21) Appl. No.: 17/756,628

(22) PCT Filed: Nov. 27, 2020

(86) PCT No.: PCT/SE2020/051137
§ 371 (c)(1),
(2) Date: May 27, 2022

(87) PCT Pub. No.: WO2021/107854
PCT Pub. Date: Jun. 3, 2021

(65) Prior Publication Data

US 2022/0411119 A1 Dec. 29, 2022

(30) Foreign Application Priority Data

Nov. 28, 2019 (SE) ..... 1951363-9

(51) Int. Cl.
*B65B 39/06* (2006.01)
*B65B 3/04* (2006.01)
(Continued)

(52) U.S. Cl.
CPC ..... *B65B 39/06* (2013.01); *B65B 3/04* (2013.01); *B65B 43/54* (2013.01); *B65B 2039/009* (2013.01); *B65B 2220/16* (2013.01)

(58) Field of Classification Search
CPC ... B67C 3/225; B65B 2039/009; B65B 39/06; B65B 43/54; B65B 2220/16
(Continued)

(56) References Cited

U.S. PATENT DOCUMENTS 6,733,224 B1 5/2004 Linner
6,919,044 B1 * 7/2005 Shibata ..... G01N 35/0092 422/65
(Continued)

FOREIGN PATENT DOCUMENTS

DE 4433361 A1 3/1996
DE 102005031695 A1 1/2007
(Continued)

OTHER PUBLICATIONS

International Search Report and Written Opinion issued for International Patent Application No. PCT/SE2020/051137, dated Feb. 8, 2021 in 17 pages.

*Primary Examiner* — Timothy L Maust
(74) *Attorney, Agent, or Firm* — Knobbe, Martens, Olson & Bear, LLP

(57) ABSTRACT

A tube filling machine (1) adapted to fill different types of empty tubes (18) simultaneously, where the filling machine (1) comprises a grouping device (11), a transfer device (9), a conveyor (7) and a filling device (2) comprising a plurality of filling nozzles (3, 4, 5, 6), where the grouping device (11) comprises a first supply tray (13) with a first type of tubes, a second supply tray (14) with a second type of tubes, a receiving tray (17) and a pick-up head (12), where the transfer device (9) is adapted to transfer a grouped row of empty tubes (18) from the receiving tray (17) to the conveyor (7), where the grouping device (11) is adapted to place a plurality of groups (21) of empty tubes adjacent each other in the receiving tray (17), where a group (21) comprises a row of the first type of tubes and a row of the second type of tubes, that the transfer device (9) is adapted to transfer a row of grouped empty tubes from the receiving tray (17) to the conveyor (9), and where the filling nozzles (3, 4, 5, 6) are
(Continued)

adapted to fill the grouped empty tubes with different content.

14 Claims, 6 Drawing Sheets

(51) Int. Cl.
*B65B 43/54* (2006.01)
*B65B 39/00* (2006.01)

(58) Field of Classification Search
USPC ..... 141/237
See application file for complete search history.

(56) References Cited

U.S. PATENT DOCUMENTS

| | | | | |
|---|---|---|---|---|
| 10,440,989 | B2 * | 10/2019 | Gardella | B65B 39/12 |
| 2010/0212264 | A1 | 8/2010 | Fischer | |
| 2018/0072445 | A1 | 3/2018 | Burkhard et al. | |

FOREIGN PATENT DOCUMENTS

| | | | |
|---|---|---|---|
| DE | 202005019906 | U1 | 4/2007 |
| DE | 202009001676 | U1 | 7/2010 |
| DE | 102009037833 | A1 | 2/2011 |
| GB | 1486783 | A | 9/1977 |
| KR | 20120004357 | U | 6/2012 |
| WO | 00/01584 | A1 | 1/2000 |

* cited by examiner

TUBE FILLING MACHINE

CROSS-REFERENCE TO RELATED APPLICATIONS

This application is the U.S. National Phase under 35. U.S.C. § 371 of International Application PCT/SE2020/051137, filed Nov. 27, 2020, which claims priority to Swedish Patent Application No. 1951363-9, filed Nov. 28, 2019. The disclosures of the above-described applications are hereby incorporated by reference in their entirety.

TECHNICAL FIELD

The present invention relates to a tube filling machine adapted to simultaneously fill different empty tubes with a content. The tube filling machine is adapted to fill two, three or four different types of empty tubes with a content at the same time. The content may be the same or may differ for the different tubes.

BACKGROUND ART

Tube filling machines having different filling capacities are known. A filling capacity from 20 tubes per minute up to 1000 tubes per minute are known. In tube filling machines having a high capacity, the machine comprises more than one filling head such that several tubes can be filled at the same time. A number of two up to twelve filling heads are known, depending on the required capacity. The filling heads may be supplied from the same paste tank, or individual filling heads may be supplied from individual paste tanks.

One advantage with individual filling heads is that it is easier to service and replace individual filling heads. It would also be possible to use different paste in different filling heads, such that different tubes receives different content at the same time. In this way, it is not necessary to replace all paste at the same time.

One problem when filling different content in different tubes with individual filling heads arranged in line next to each other is that the different tubes must be arranged in the right order, such that each tube receives the right paste. In a regular tube filling machine having a higher capacity, the empty tubes are picked up by a pick-up head. The pick-up head will pick up e.g. eight, ten or more empty tubes at the same time and will place the tubes in the tube holders of the tube conveyor. When different tubes are to be filled, the tubes must thus come packed in the right order. But with empty tubes packed in one specific order, it is impossible to change the order or amount of different tubes. This solution is very inflexible.

While this solution work well for specific purposes, there is still room for improvements.

SUMMARY OF THE INVENTION

An object of the invention is to provide a tube filling machine. A further object of the invention is to provide a method for simultaneously filling different empty tubes.

The solution to the problem according to the invention is described in the characterizing part of claim 1 regarding the tube filling machine and in claim 8 regarding the method. The other claims contain advantageous further developments of the tube filling machine and the method.

In a tube filling machine adapted to simultaneously fill different types of empty tubes, where the filling machine comprises a grouping device, a transfer device, a conveyor and a filling device comprising a plurality of filling nozzles, where the grouping device comprises a first supply tray with a first type of tubes, a second supply tray with a second type of tubes, a receiving tray and a pick-up head, where the transfer device is adapted to transfer empty tubes from the receiving tray to the conveyor, the object of the invention is achieved in that the grouping device is adapted to place a plurality of groups of empty tubes adjacent each other in the receiving tray, where a group comprises a row of the first type of tubes and a row of the second type of tubes, that the transfer device is adapted to transfer a row of grouped empty tubes from the receiving tray to the conveyor, and where the filling nozzles are adapted to fill the row of grouped empty tubes with different content.

By this first embodiment of a tube filling machine according to the invention, a machine that can fill different types of empty tubes simultaneously is provided, such that a predefined order of different types of empty tubes can be filled at the same time. In one example, the tube filling machine is adapted to fill two, three or four different types of empty tubes with different content at the same time: In this way, the different types of tubes are both filled and sorted in a predefined order at the same time, such that a group of filled tubes can be packed directly at a packing station, without having to be grouped in an additional grouping device. It is possible to use more different types of empty tubes, depending on the number of individual filling heads of the tube filling machine. However, the tube filling machine is especially suitable for a tube filling machine having four separate filling heads. The tube filling machine may fill all of the different empty tubes with a different content, or may fill two or more empty tubes with a different content, depending on the number of different types of empty tubes.

One advantage of filling different types of tubes with different content at the same time with the tubes grouped in a predefined order is that the packing of different types of filled tubes in one package is simplified. In a promotional offer, two or three different tubes may e.g. be packed in one package, or three tubes of one type and a fourth tube of another type may be packed in one package. Having the filled tubes grouped in the right order simplifies the packing of the tubes, and the ordinary packing machine can be used without any adaptations.

The receiving tray comprises in one example separating means that provides every tube with an individual position, where a tube is supported by the separating means. In this way, all positions in the receiving tray must not be filled. This is of advantage e.g. when three different types of tubes are to be used in a tube filling machine comprising four individual filling heads. In this case, one row in the receiving tray is left empty, and one filling head of the tube filling machine is not used.

It is also possible to insert the empty tubes in an ordinary open receiving tray that is tilted somewhat such that the tubes bear on each other and does not fall over. The tray must in this case be tilted in a perpendicular way when the groups of empty tubes are transferred from the receiving tray, such that the order of empty tubes is kept and that the tubes does not fall over.

The grouping device is adapted to pick up rows of empty tubes from supply trays holding different types of empty tubes, and to place them in groups in the receiving tray. The empty tubes are arranged in groups of empty tubes, where a group of empty tubes contains e.g. two, three or four rows of different types of empty tubes. Each row of empty tubes are picked up from a supply tray holding one type of an empty tube.

In one development of the invention, the grouping device will pick up a row of empty tubes from two different supply trays, each supply tray holding one type of empty tubes. The rows of different types of empty tubes will be placed in the first and second row of the receiving tray and will constitute a first group of empty tubes in the receiving tray. A further group of empty tubes will be placed adjacent the first group in the receiving tray. The grouping device will continue to place groups of empty tubes in the receiving tray until the receiving tray is filled with groups of empty tubes, such that every second row contains a first type of empty tubes and every other row contains the other type of empty tubes.

In one development of the invention, the grouping device will pick up a row of empty tubes from three different supply trays, each supply tray holding one type of empty tubes. The rows of different types of empty tubes will be placed in the first three rows of the receiving tray, and are comprised in the first group of empty tubes in the receiving tray. A further group of empty tubes will be inserted adjacent the first group in the receiving tray. In this case, where a group comprises three different tubes, the group of empty tubes will consist of a first row of empty tubes of a first type, a second row of empty tubes of a second type, a third row of empty tubes of a third type, and a fourth row without any tubes. The grouping device will continue to place groups of empty tubes in the receiving tray until it is filled with groups of empty tubes.

In one development of the invention, the grouping device will pick up a row of empty tubes from four different supply trays, each supply tray holding one type of empty tubes. The rows of different types of empty tubes will be placed in the first four rows of the receiving tray, and will constitute a first group of empty tubes in the receiving tray. A further group of empty tubes will be placed adjacent the first group in the receiving tray. In this case, where a group consists of four different tubes, the group of empty tubes contains a first row of empty tubes of a first type, a second row of empty tubes of a second type, a third row of empty tubes of a third type, and a fourth row of empty tubes of a fourth type. The grouping device will continue to place groups of empty tubes in the receiving tray until it is filled with groups of empty tubes.

For a tube filling machine having e.g. 10 individual filling heads, it would be possible to use five different types of empty tubes, where a group of empty tubes would consist of five different types of empty tubes.

When the receiving tray has been filled with groups of empty tubes, the receiving tray will contain rows of different types of empty tubes arranged adjacent each other in a predefined order. When a transfer device transfers a row of grouped empty tubes from a column of the receiving tray, the row will contain different types of empty tubes grouped in the predefined order. Depending on the type of transfer device used, the receiving tray may be forwarded to position the grouped row of empty tubes next to the filling conveyor. In one example, the receiving tray is rotated by 90 degrees before the transfer device transfers the grouped row of empty tubes to the filling conveyor, such that the grouped row of empty tubes is positioned in parallel with the filling conveyor. It is also possible to rotate the pick-up head of the transfer device when the empty tubes are transferred to the filling conveyor. In a method for simultaneously filling different types of empty tubes with a content, the steps of; placing a group of empty tubes in a receiving tray, where the group of empty tubes comprises at least two rows of different types of empty tubes; placing another group of empty tubes adjacent the first group of empty tubes in the receiving tray; repeating the placement of groups of empty tubes in the receiving tray until the receiving tray is filled with groups of empty tubes, transferring a row of grouped empty tubes to a filling conveyor by a transfer device, and filling the grouped empty tubes with content by individual filling nozzles are comprised.

By the inventive method, different types of empty tubes can be filled with different contents in the same tube filling machine at the same time. Each filling head is in this case provided with a different content, and the content is filled in the corresponding empty tubes. Since the tubes are grouped in the receiving tray and a row of grouped tubes is transferred from the receiving tray, it is secured that the right content is filled in the right tube.

The method is suitable to be used to fill two, three, four or more different types of empty tubes at the same time. The receiving tray is provided with separating means, such that each empty tube is supported individually. This allows the tube filling machine to use all or some of the individual filling heads to fill empty tubes. In the case when three different tubes are filled, one filling head is not used.

BRIEF DESCRIPTION OF DRAWINGS

The invention will be described in greater detail in the following, with reference to the embodiments that are shown in the attached drawings, in which.

DETAILED DESCRIPTION OF THE PREFERRED EMBODIMENTS

The embodiments of the invention with further developments described in the following are to be regarded only as examples and are in no way to limit the scope of the protection provided by the patent claims.

The tube filling machine according to the invention is adapted to simultaneously fill different types of empty tubes with a content, where the empty tubes are grouped in a predefined manner. The tube filling machine is adapted to fill two, three, four or more different tubes at the same time. It is of advantage if the tubes have the same size, i.e. the same height and the same diameter, but some variations in size is also possible, especially in height. The tubes may also have different caps and of course different printing. If the tube filling machine is provided with individual sealing devices, it is also possible to use tubes of different materials.

Figure 1:
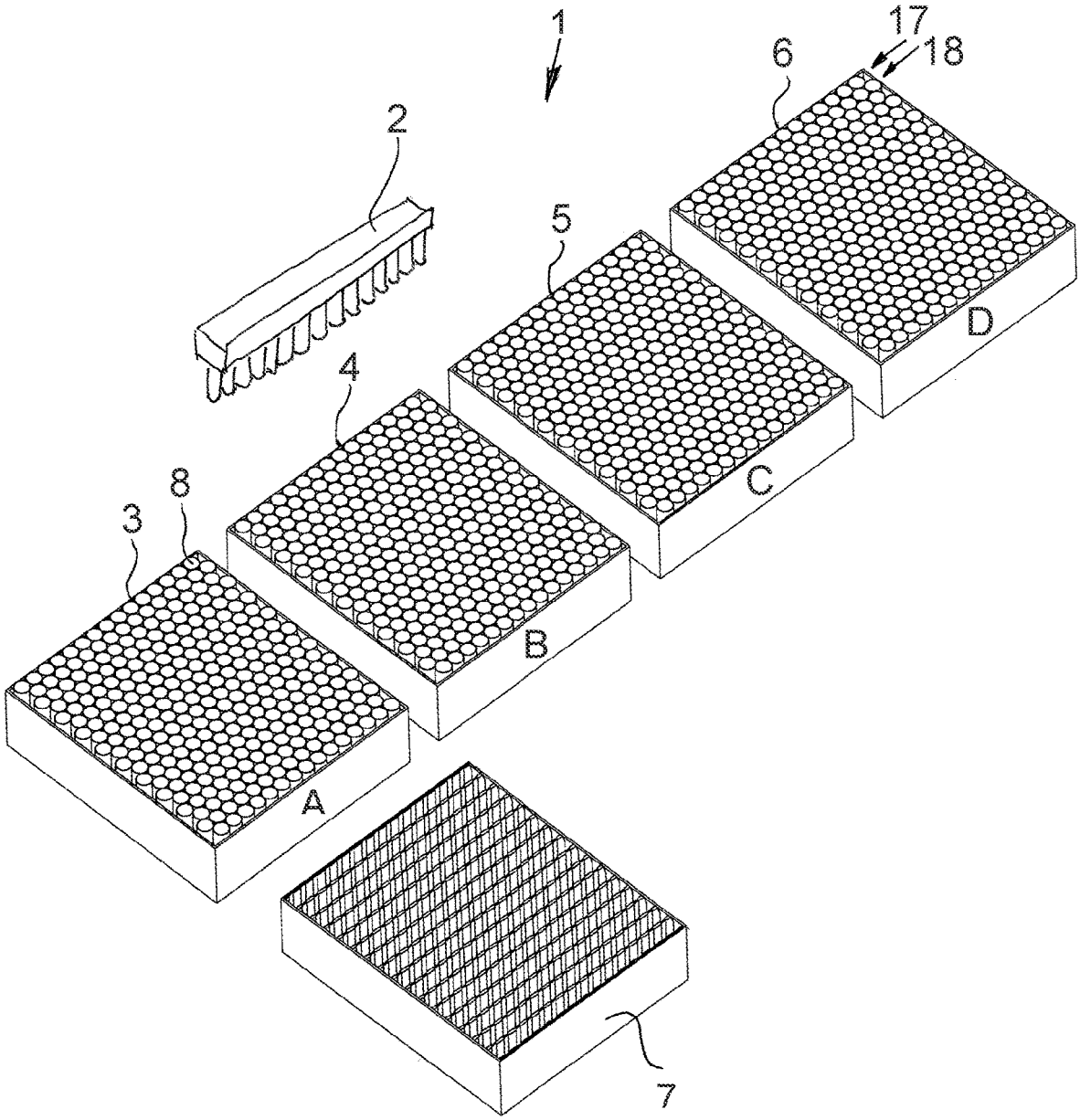
FIG. 1 shows a schematic view of a tube filling machine according to the invention.
Figure 2:
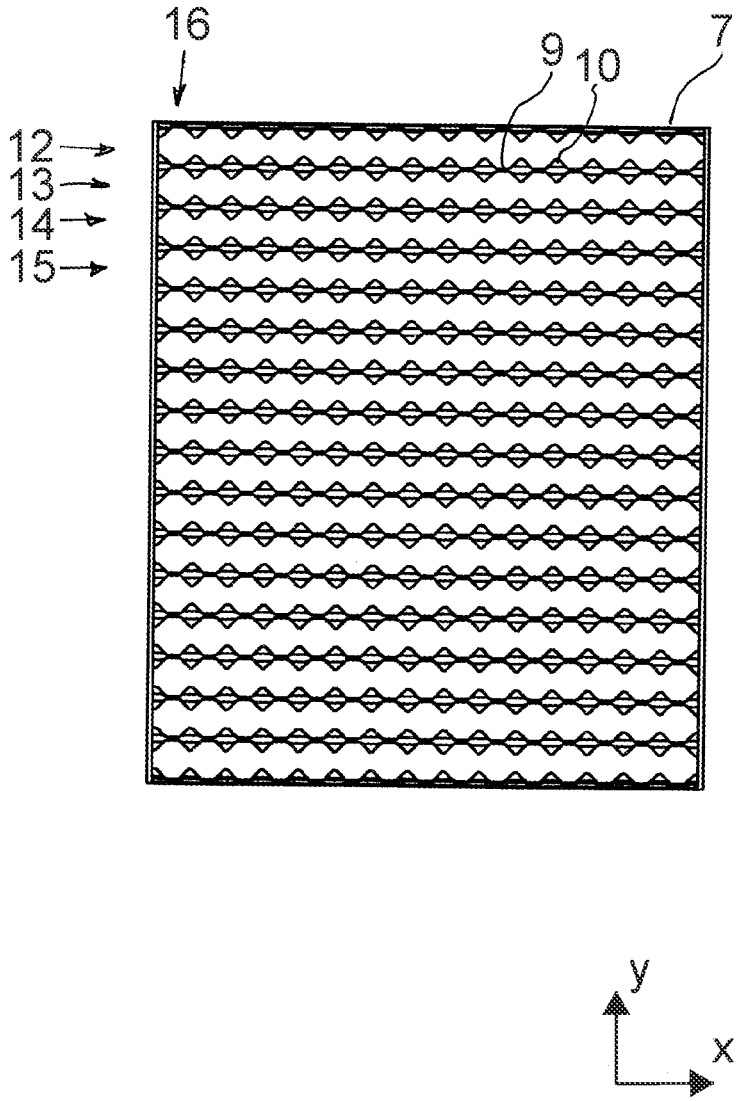
FIG. 2 shows a view of a grouping device.

In FIG. 1, a schematic view of a tube filling machine 1 is shown. The tube filling machine 1 comprises a grouping device 11, a transfer device 9, a conveyor 7 and a filling device 2 comprising a plurality of filling nozzles, a first filling nozzle 3, a second filling nozzle 4, a third filling nozzle 5 and a fourth filling nozzle 6. The grouping device 11, shown in FIG. 2, comprises at least two supply trays holding different types of empty tubes. The grouping device further comprises a receiving tray 17 and a pick-up head 12. The transfer device 9 is adapted to transfer empty tubes 18 from the receiving tray 17 to the filling conveyor 7.

The pick-up head 12 is a conventional pick-up head used in tube filling machines. The pick-up head may e.g. pick up empty tubes by vacuum cups holding the empty tubes on the outer side wall, or may pick up empty tubes by holding the empty tubes on the inner side wall. The pick-up head is adapted to pick up a row of empty tubes 18 from a supply tray. A row may e.g. contain between 8 to 20 empty tubes. The pick-up head may be the conventional pick-up head arranged in a tube filling machine that places empty tubes on the tube filling conveyor, or may be an additional pick-up head. The pick-up head may e.g. be mounted on an industrial robot. The transfer device 9 may also comprise a similar pick-up head or may transfer a grouped row of empty tubes to the filling conveyor with a different type of pick-up head.

In the shown example, the tube filling machine is provided with four individual filling heads, each having a filling nozzle. In the shown example, the grouping device comprises four supply trays, a first supply tray 13 with a first type of tubes, a second supply tray 14 with a second type of tubes, a third supply tray 15 with a third type of tubes and a fourth supply tray 16 with a fourth type of tubes. The number of rows in the receiving tray 17 must be dividable by the number of individual filling nozzles of the filling device 2 in order to be able to provide a row of grouped empty tubes. The receiving tray 17 may e.g. comprise 8, 12 or 16 rows.

Figure 3:
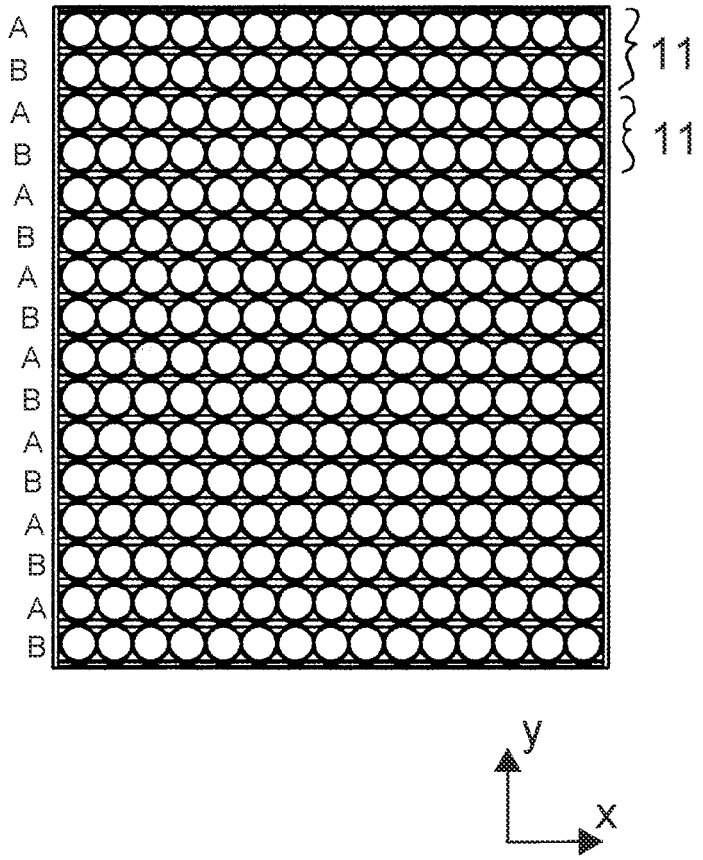
FIG. 3 shows an empty receiving tray.

In the shown example, the pick-up head is adapted to pick up empty tubes from two, three or four different supply trays. The grouping device further comprises a receiving tray 17, also shown in FIG. 3, in which the rows of empty tubes are placed. The receiving tray comprises a number of rows and a number of columns, in the shown example 16 rows and 15 columns. The receiving tray is provided with separating means that separates the rows and columns, such that each empty tube can be supported individually. In the shown example, the receiving tray is provided with dividing walls 19 separating the rows from each other. Each dividing wall is provided with position protrusions 20 separating each position of a tube in a row, such that the columns are also separated from each other. In a supply tray 13, 14, 15, 16, the rows 27, 28 are arranged along the x-axis. In the receiving tray 17, the rows 22, 23, 24, 25 are arranged along the x-axis and the columns, e.g. the first column 26, are arranged along the y-axis.

The pick-up head 12 of the grouping device 11 is adapted to pick up rows of empty tubes 18 from the supply trays holding the different types of empty tubes that are to be used. In the example, the number of different tubes that may be used is two, three or four. The pick-up head is thus adapted to pick up empty tubes from two, three or four different supply trays. The empty tubes 18 are arranged as groups of empty tubes in the receiving tray, where a group of empty tubes contains two, three or four rows of different types of empty tubes. In one example, the pick-up head will pick up a complete row of empty tubes from a supply tray holding one type of empty tubes. The pick-up head may also pick up two rows at the same time, e.g. if a group of empty tubes will contain two empty tubes of a first type arranged adjacent each other and two empty tubes of a second type arranged adjacent each other. The pick-up head will in one example start with the first row 27 of empty tubes and will then pick-up the second row 28 of empty tubes etc. A supply tray is tilted somewhat such that the first row of empty tubes is the uppermost row of empty tubes. The pick-up head will place the row of empty tubes in the receiving tray.

In one development of the invention, the grouping device 1 will pick up a row of empty tubes 18 from two different supply trays 13, 14, each supply tray holding one type of empty tubes. In the shown example, supply tray 13 holds empty tubes of type A and supply tray 14 holds empty tubes of type B. The group of empty tubes 21, i.e. the rows of different types of empty tubes, will be placed in a the first two rows of the receiving tray 17. In this example, the first group is placed in rows 22 and 23. A further group of empty tubes will be placed adjacent the first group of empty tubes in the receiving tray, in the shown example in rows 24 and 25. The grouping device will continue to place groups of empty tubes in the receiving tray, until it is filled with groups of empty tubes, such that every second row contains the type A of empty tubes and every other row contains the type B of empty tubes.

Figure 4:
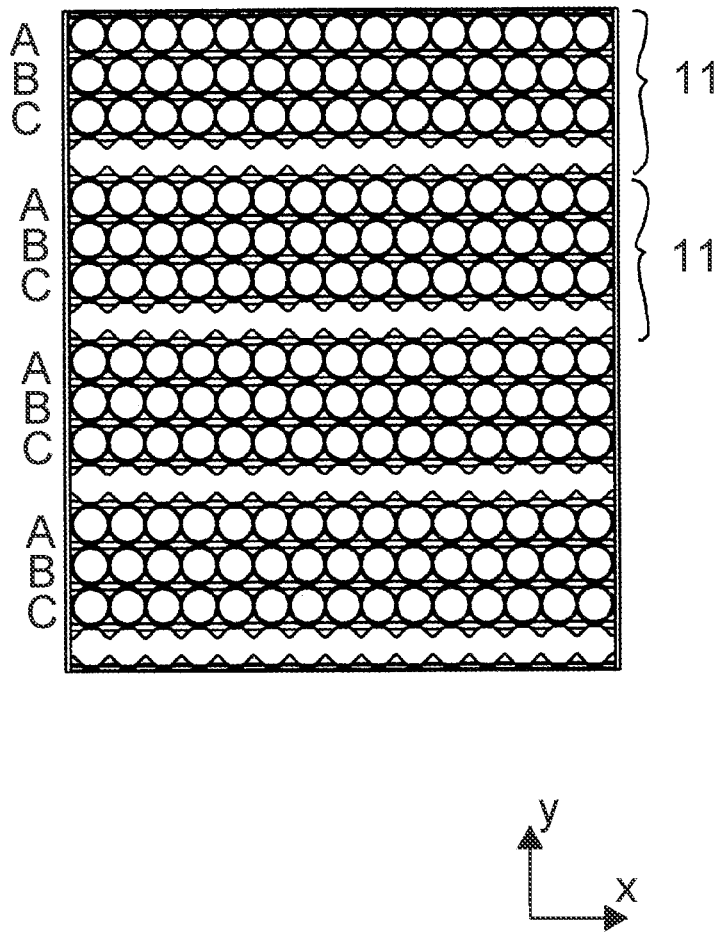
FIG. 4 shows a receiving tray holding two different types of empty tubes.

FIG. 4 shows an example of a receiving tray 17 filled with empty tubes of type A and type B. The tubes are now grouped such that the tube filling machine will be able to fill every second tube with a different content, e.g. paste, than the other tubes. In this example, the first and the fourth filling heads of the tube filling machine are filled with a first paste, and the second and third filling heads are filled with a second paste. It would also be possible to arrange the group of empty tubes such that the group of empty tubes contains two empty tubes of type A arranged adjacent each other and two empty tubes of type B arranged adjacent each other. The group of empty tubes would thus contain a first and a second row of empty tubes of type A, and a third and a fourth row of empty tubes of type B.

In one development of the invention, the grouping device 11 will pick up a row of empty tubes 18 from three different supply trays 13, 14, 15, each supply tray holding one type of empty tubes. In this example, supply tray 13 holds empty tubes of type A, supply tray 14 holds empty tubes of type B and supply tray 15 holds empty tubes of type C. The group of empty tubes 21, i.e. the rows of different types of empty tubes, will be placed in the first three rows in the receiving tray 17. In this example, the first group is placed in rows 22, 23, 24 and 25. In this case, where three different types A, B, C of tubes are used, the group of empty tubes contains a first row of empty tubes of type A, a second row of empty tubes of type B, a third row of empty tubes of type C, and a fourth row without any tubes. A second group of empty tubes will be placed adjacent the first group of empty tubes in the receiving tray. The grouping device will continue to insert groups of empty tubes in the receiving tray until it is filled with groups of empty tubes.

Figure 5:
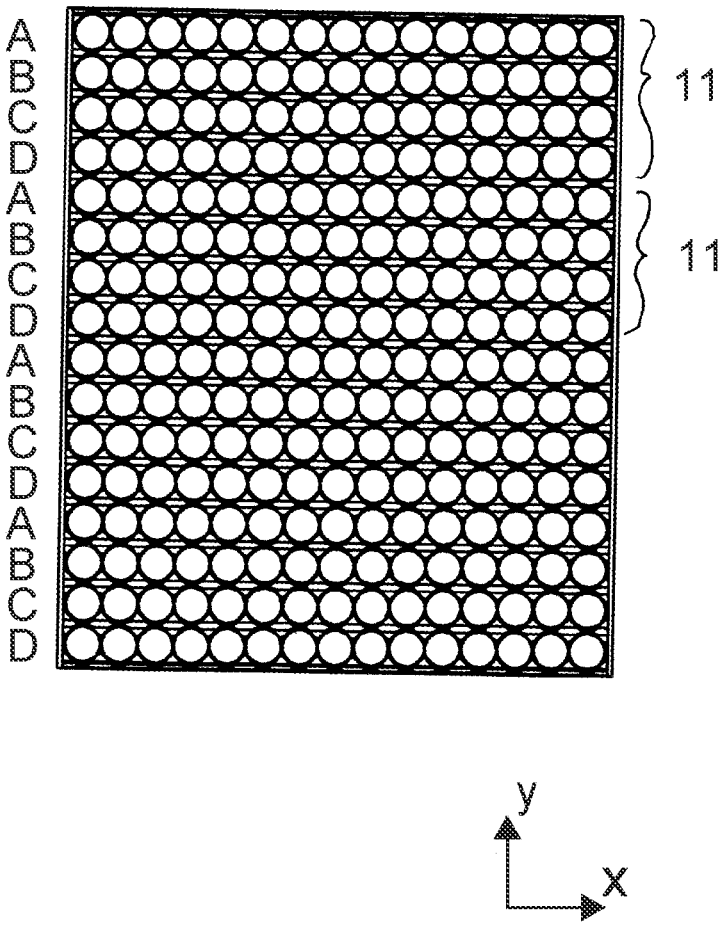
FIG. 5 shows a receiving tray holding three different types of empty tubes.

FIG. 5 shows an example of a receiving tray 17 filled with empty tubes of type A, type B and type C. The receiving tray contains three different types of empty tubes, arranged in rows next to each other, with every fourth row being empty. In this way, the transfer device will be able to transfer a row of grouped empty tubes to the filling conveyor, by picking up a column from the receiving tray. Depending on the type of transfer device, the receiving tray may be rotated by 90 degrees such that the columns of the receiving tray are parallel with the filling conveyor. In this example, the transfer device can pick up grouped rows of empty tubes comprising three different types. The tubes are now grouped such that the tube filling machine will be able to fill the three different types of empty tubes with three different contents, e.g. pastes. In this example, the first filling nozzle 3 of the tube filling machine will fill a first paste, the fourth filling nozzle 6 will fill a second paste and the third filling nozzle 5 will fill a third paste. The second filling nozzle 4 is not used in this example.

In one development of the invention, the grouping device 1 will pick up a row of empty tubes 18 from four different supply trays 13, 14, 15, 16, each supply tray holding one type of empty tubes. In the shown example, supply tray 13 holds empty tubes of type A, supply tray 14 holds empty tubes of type B, supply tray 15 holds empty tubes of type C and supply tray 16 holds empty tubes of type D. The group of empty tubes 21 will be placed in the first four rows of the receiving tray 17. In this example, the first group is placed in rows 22, 23, 24 and 25. In this case, where four different types A, B, C, D of tubes are used, the group of empty tubes contains a first row of empty tubes of type A, a second row of empty tubes of type B, a third row of empty tubes of type C, and a fourth row of empty tubes of type D. A second group of empty tubes will be placed adjacent the first group of empty tubes in the receiving tray. The grouping device will continue to insert groups of empty tubes in the receiving tray until it is filled with groups of empty tubes.

Figure 6:
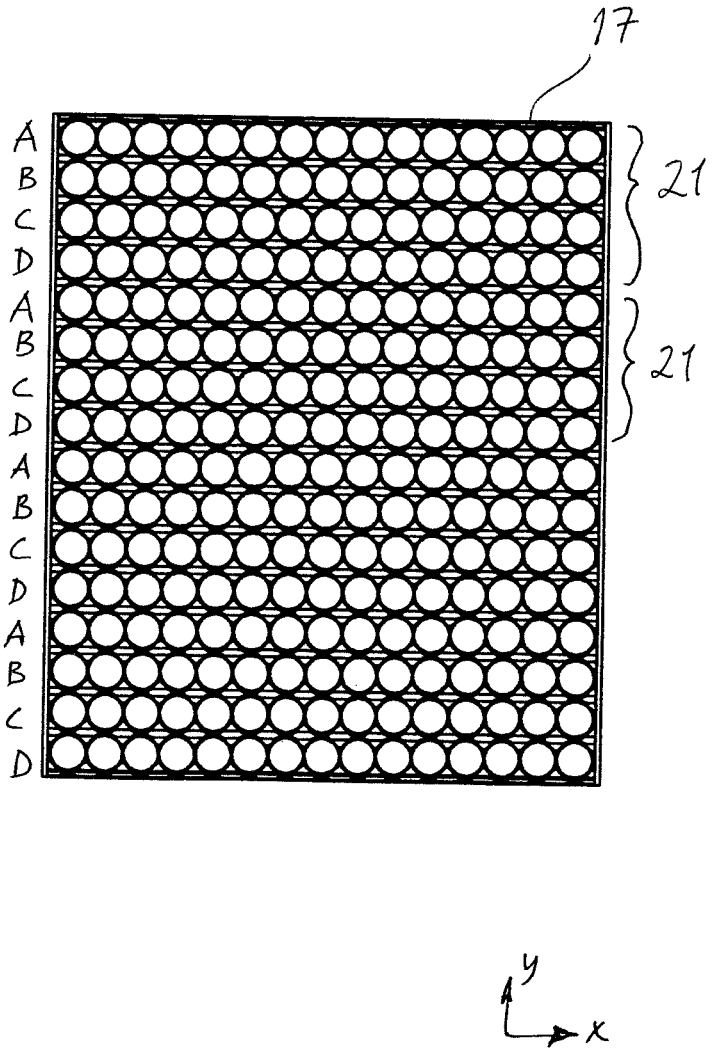
FIG. 6 shows a receiving tray holding four different types of empty tubes.

FIG. 6 shows an example of a receiving tray 17 filled with empty tubes of type A, type B, type C and type D. The receiving tray will now contain four different types of empty tubes, arranged in rows next to each other. A transfer device will now be able to transfer a row of grouped tubes to a filling conveyor, by picking up a column of the receiving tray. The receiving tray may be rotated by 90 degrees such that the columns of the receiving tray are parallel with the filling conveyor. The transfer device of the tube filling machine will be able to pick up grouped rows of empty tubes having four different types of empty tubes. The tubes are now grouped such that the tube filling machine will be able to fill the four different types of empty tubes with different pastes. In this example, the first filling nozzle 3 of the tube filling machine will fill a first paste, the fourth filling nozzle 6 will fill a second paste, the third filling nozzle 5 will fill a third paste and the second filling nozzle 4 will fill a fourth paste.

When the receiving tray has been filled with groups of empty tubes, the receiving tray will contain groups of different types of empty tubes arranged adjacent each other in a predefined order. When a pick-up head picks up a grouped row of empty tubes from a column, e.g. from the first column 26, of the receiving tray, the grouped row of empty tubes will contain different types of empty tubes arranged in the predefined order. This may e.g. be achieved in that the receiving tray is rotated by 90 degrees, such that the pick-up head can pick up grouped rows of empty tubes from the receiving tray, or that the pick-up head is rotated by 90 degrees when the grouped rows of empty tubes are picked up from the receiving tray.

The empty tubes may also be arranged in other ways if required. In one example, a group of empty tubes 21 comprises three rows of empty tubes of the same type, and a fourth row of empty tubes of another type. This may e.g. be used for promotional purposes, where a fourth tube with a different content is given as a gift when a pack of three tubes is bought. The pick-up head will in this case pick up three rows from a first supply tray 13 and place them in the first 22, second 23 and third 24 row of the receiving tray 17 and then pick up a row of empty tubes from a second supply tray 14 and place them in the fourth row 25. The pick-up head will continue to consecutively pick up three rows of empty tubes from the first supply tray and a row of empty tubes from the second supply tray and to place them in alternating rows in the receiving tray, with every fourth row being of a different type.

The receiving tray will now contain two types of empty tubes, arranged with three tubes of the same type next to each other, with every fourth row being of a different type. The transfer device will now be able to pick up grouped rows of empty tubes, where every fourth tube is of a different type. The tubes are now grouped such that the tube filling machine will be able to fill three empty tubes with one paste and a fourth empty tube with a different paste. In this example, the first, third and fourth filling nozzles of the tube filling machine will fill a first paste, and the second filling head will fill a second paste.

The receiving tray may be rotated by 90 degrees before the transfer device transfers the grouped rows to the filling conveyor. This may facilitate for a pick-up head of the transfer device to pick up grouped rows with different empty tubes, sorted in the desired pattern. The tube filling machine will be used for filling different empty tubes at the same time, which provides a flexible way of using the tube filling machine when the full capacity of the tube filling machine is not required for a single type of empty tubes. The tube filling machines is preferably provided with a medium tube filling capacity, e.g. in the range between 200-500 tubes per minute, but higher capacity machines may also be used. Machines with lower capacity does not have pick-up heads that pick up such large rows of empty tubes at the same time, and are often not provided with several individual filling heads. Tube filling machines having a larger capacity are used for large quantities of the same type of tube, and it is most often not necessary to divide the tube flow.

FIG. 1 shows an example in which a row of grouped empty tubes comprising four different tubes A, B, C, D are filled by four different filling nozzles 3, 4, 5, 6. In the shown example, the filling nozzles are offset somewhat. In the shown example, tube A is filled by filling nozzle 3, tube B is filled by filling nozzle 6, tube C is filled by filling nozzle 5, and tube D is filled by filling nozzle 4. The filling nozzles are spaced apart such that all different empty tubes are filled at the same time. The container 8 of the filling device 2 is preferably provided with different compartments, holding different contents such as paste, depending on how many different tubes that are to be filled. In this case, the filling conveyor is advanced by four steps for each filling operation.

In the inventive method for filling tubes in a receiving tray, groups of empty tubes containing rows of different types of empty tubes are picked up from different support trays and are inserted in rows in the receiving tray in a predefined order. The method encompasses two, three, four or more different types of empty tubes. The size of the rows of the receiving tray correspond to the size of the rows of the supply trays, and may e.g. be in the range between 9-15 empty tubes. The size of the rows of the receiving tray corresponds to the pick-up head that is used, but to provide a flexible solution that can be used for a different amount of empty tube types, each row of the receiving tray in the shown example should hold 8, 12 or 16 tubes. For a tube filling machine having e.g. ten individual filling heads, the number of rows are suitably 10, 15 or 20.

In the method, the pick-up head first picks up a row with empty tubes from a first supply tray. The tubes are placed in the first row of the receiving tray. The pick-up head will then pick up a row of empty tubes from a second supply tray and will insert these in the second row of the receiving tray.

If only two different types of tubes are used, a group of empty tubes have been placed in the receiving tray and the pick-up head will continue to pick up empty tubes from the first supply tray and the second supply tray and to place them in further groups in the receiving tray, such that every second empty tube is of the first type and every other empty tube is of the second type.

If three different types of empty tubes are comprised in a group of empty tubes, the pick-up head will pick up a row of empty tubes from a third supply tray and will place them in the third row of the receiving tray, after the first and the second rows are filled with tubes from the first supply tray and the second supply tray. No tubes will be placed in the fourth row, which will be left empty. The pick-up head will then continue to pick-up empty tubes from the first supply tray, and will place these in the fifth row of the receiving tray. After that, the sixth and the seventh rows are filled with empty tubes from the second and the third supply trays, respectively, with the eighth row being left empty. For a receiving tray having eight rows, the tray is now filled. For a receiving tray having 12 or 16 rows, this placement of empty tubes is repeated until the receiving tray is full.

If four different types of empty tubes are comprised in a group of empty tubes, the pick-up head will pick up a row of empty tubes from a fourth supply tray and will insert them in the fourth row of the receiving tray, after the first, the second and the third rows are filled with tubes from the first supply tray, the second supply tray and the third supply tray. The pick-up head will then continue to pick-up empty tubes from the first supply tray, and will place these in the fifth row of the receiving tray. After that, the sixth, the seventh and the eighth rows are filled with empty tubes from the second, the third and the fourth supply trays, respectively. For a receiving tray having eight rows, the tray is now filled. For a receiving tray having 12 or 16 rows, this positioning of empty tubes is repeated until the receiving tray is full.

In a development of the method, the empty tubes may also be placed in the receiving tray one type of the time. In an example where a group of empty tubes comprises two different types of empty tubes, the pick-up head will first place empty tubes of the first type from the first supply tray in the first, the third, the fifth rows etc. until every second row is filled with empty tubes of the first type. The pick-up head will then fill the rest of the rows with empty tubes of a second type from the second supply tray, such that ever other row is filled with empty tubes from the second supply tray. This is possible since the receiving tray is provided with separating means, such that every tube position is supported individually. This method may also be used when three, four or more different types of empty tubes are used. This may reduce the time for packing the receiving tray further, and may further simplify the replacement of supply trays.

In another example of the method, the tube filling machine is provided with two pick-up heads. In this case, with a group of empty tubes comprising two different types of empty tubes, each pick-up head may only pick up one type of empty tubes each, such that the first pick-up head only picks up empty tubes from the first supply tray, and the second pick-up head only picks up empty tubes form the second supply tray. This will simplify the packing of a receiving tray further.

The invention is not to be regarded as being limited to the embodiments described above, a number of additional variants and modifications being possible within the scope of the subsequent patent claims.

REFERENCE SIGNS

1: Tube filling machine
2: Filling device
3: First filling nozzle
4: Second filling nozzle
5: Third filling nozzle
6: Fourth filling nozzle
7: Conveyor
8: Container
9: Transfer device
11: Grouping device
12: Pick-up head
13: First supply tray
14: Second supply tray
15: Third supply tray
16: Fourth supply tray
17: Receiving tray
18: Empty tube
19: Dividing wall
20: Position protrusion
21: Group of empty tubes
22: First row
23: Second row
24: Third row
25: Fourth row
26: First column of receiving tray
27: First row of supply tray
28: Second row of supply tray

What is claimed is:

1. A tube filling machine adapted to simultaneously fill different types of empty tubes, the filling machine comprises:

a grouping device,
a transfer device,
a conveyor and
a filling device comprising a plurality of filling nozzles,
wherein the grouping device comprises:
a first supply tray with a first type of tubes,
a second supply tray with a second type of tubes,
a receiving tray and
a pick-up head,
wherein the transfer device is adapted to transfer empty tubes from the receiving tray to the conveyor,
wherein the grouping device is adapted to place a plurality of groups of empty tubes adjacent each other in the receiving tray,
wherein a group comprises a row of the first type of tubes and a row of the second type of tubes, that the transfer device is adapted to transfer a row of grouped empty tubes from the receiving tray to the conveyor, and where the filling nozzles are adapted to fill the row of grouped empty tubes with different content.

2. The tube filling machine according to claim 1, wherein the rows and columns of the receiving tray are separated by separating means.

3. The tube filling machine according to claim 1, wherein the groups of empty tubes placed adjacent each other in the receiving tray by the grouping device comprises a row of the first type of tubes, a row of the second type of tubes and a row of a third type of tubes.

4. The tube filling machine according to claim 1, wherein the groups of empty tubes placed adjacent each other in the receiving tray by the grouping device comprises a row of the first type of tubes, a row of the second type of tubes, a row of a third type of tubes and a row of a fourth type of tubes.

5. The tube filling machine according to claim 1, wherein the grouping device is adapted to rotate the receiving tray by 90 degrees when the groups of empty tubes has been placed in the receiving tray.

6. The tube filling machine according to claim 1, wherein the number of rows in the receiving tray is dividable by the number of individual filling nozzles of the filling device.

7. The tube filling machine according to claim 1, wherein the receiving tray comprises 8, 12 or 16 rows.

8. A method for simultaneously filling different types of empty tubes with a content, comprising the steps of:

placing a group of empty tubes in a receiving tray, where the group of empty tubes comprises at least two rows of different types of empty tubes, placing another group of empty tubes adjacent the first group of empty tubes in the receiving tray until the receiving tray is filled with groups of empty tubes, transferring a row of grouped empty tubes from a column of the receiving tray to a filling conveyor by a transfer device, and filling the grouped row of empty tubes with content by individual filling nozzles.

9. The method according to claim 8, wherein all tubes of a group of empty tubes are placed in the receiving tray before the next group of empty tubes are placed in the receiving tray.

10. The method according to claim 8, wherein all empty tubes of a first type of empty tubes are placed in the receiving tray before all empty tubes of a further type of empty tubes are placed in the receiving tray.

11. The method according to claim 8, wherein a group of empty tubes comprises a first row of a first type of empty tubes, and a second row of a second type of empty tubes.

12. The method according to claim 8, wherein a group of empty tubes comprises a first row of a first type of empty tubes, a second row of a second type of empty tubes, a third row of a third type of empty tubes, and a fourth row that contains no empty tubes.

13. The method according to claim 8, wherein a group of empty tubes comprises a first row of a first type of empty tubes, a second row of a second type of empty tubes, a third row of a third type of empty tubes, and a fourth row of a fourth type of empty tubes.

14. The method according to claim 8, wherein the method comprises the additional step of: rotating the receiving tray by 90 degrees, such that a transfer device can pick up grouped rows comprising different types of empty tubes from a column of the receiving tray.

* * * * *